United States Patent [19]

Akazawa

[11] Patent Number: 4,525,085

[45] Date of Patent: Jun. 25, 1985

[54] SERIAL PRINTER

[75] Inventor: Hiroyuki Akazawa, Shiojiri, Japan

[73] Assignee: Epson Corporation, Tokyo, Japan

[21] Appl. No.: 430,420

[22] Filed: Sep. 30, 1982

Related U.S. Application Data

[62] Division of Ser. No. 305,413, Sep. 24, 1981, Pat. No. 4,452,543.

[30] Foreign Application Priority Data

Sep. 25, 1980 [JP] Japan ..... 55-136236

[51] Int. Cl.[3] ..... B41J 11/20

[52] U.S. Cl. ..... 400/59; 400/355

[58] Field of Search ..... 400/55, 59, 56, 355

[56] References Cited

U.S. PATENT DOCUMENTS 3,960,256 6/1976 Bickoff et al. ..... 400/59

4,086,997 5/1978 Wu ..... 400/59

4,178,106 12/1979 Mailer et al. ..... 400/59

4,189,244 2/1980 Harrison ..... 400/59

4,268,177 5/1981 Veale ..... 400/59

*Primary Examiner*—William Pieprz

*Attorney, Agent, or Firm*—Blum Kaplan Friedman Silberman & Beran

[57] ABSTRACT

The print head of a serial printer includes a protruding plug which is seated and locked into a receptacle on a translating carriage. An endless belt has teeth engaged in a correspondingly contoured groove of the carriage for positive connection between carriage and belt, whereby the head traverses the printing medium for printing thereon. The platen is positively and simply held and includes a resin surface for impact of print wires. The gap between the head and platen is readily adjusted in steps by motion of a lever.

4 Claims, 12 Drawing Figures

SERIAL PRINTER

This is a division of application Ser. No. 305,413 filed Sept. 24, 1981, now U.S. Pat. No. 4,452,543, issued June 5, 1984.

BACKGROUND OF THE INVENTION

This invention relates generally to a serial printer of the type using a wire dot printing head and more particularly, to a serial printer which provides a precision construction which is readily assembled, disassembled and adjusted. In many constructions of serial printers of the prior art, the print head is fixed on a head carriage by means of screws. Using screws makes it difficult to mount the print head on the carriage and to remove it from the carriage. Also, in serial printers using wire dot print heads, the print heads must be replaced when wires have been worn away through printing. Conventional methods however have the disadvantage that mounting and removing of the print head are difficult. Additionally, careful measurement and adjustment of the distance between the print head and the platen are necessary in order to properly position the print head.

In U.S. Pat. No. 3,958,254, an electronic printer is disclosed wherein mounting and dismounting of the print head to and from the head carriage is facilitated. Though the mounting and removing of the print head according to this patent is easier than it is in constructions where the print head is fastened by screws, there are disadvantages in that many parts are necessary for fixing the print head and the shapes of the parts are intricate. When using a print head of the impact type, for example, a wire dot printer, this construction makes it difficult to keep the head fixed properly because of the impact of the printing process.

In printers, there is also a need for adjusting the gap between the printer head and the platen. Such an adjustment is necessary to accommodate the use of different page thickness or a different number of copies, or the magnitude of the impact force during printing. In U.S. Pat. No. 4,189,244, an adjustment device for the platen gap is disclosed. However, in this construction, there is the disadvantage of high cost because the mechanism for rotating an offset shaft is complicated and requires many parts.

In the prior art, an endless belt having teeth is frequently used to drive a head carriage on which a printing head of a serial printer is mounted. However, with a timing belt there is difficulty in connecting the belt to the head carriage because it is endless. As a result of this endless construction, it is usually necessary that another component be used for setting the timing belt on the head carriage and this component is generally fixed by screws or the like. Otherwise, a timing belt which is cut, that is, which is not endless, is used in order to reduce the difficulty of connecting the timing belt to the head carriage. These approaches to the problem have disadvantages in that the structure connecting the timing belt to the head carriage is complicated and costly to produce. Moreover, assembly and disassembly of the structure are difficult.

Because printing is carried out by moving the print head laterally relative to the print medium, the print head is electrically connected by means of a flexible print cable. A wire dot print head and flexible print cable have been connected in such a way that a coil for driving wires is fixed on a rigid circuit board and the rigid circuit board is combined with the flexible print calbe by using a connector, or the like. Therefore, this construction uses many components and many portions which must be connected. As a result, the reliability of the products completed using these components is low, and the cost is high to provide the parts and to assemble them in production. In U.S. Pat. No. 4,265,549, a flat flexible printed circuit cable for a print head is disclosed. In this patent, a thin flexible printed circuit cable encircles the solenoid assemblies and has embedded therein thin flexible wires each terminating at one end in a connection with a solenoid assembly. The opposite ends are connected to a connector plug mounted on the cable assembly and adapted to releasably receive a mating connector. But, in accordance with this construction, the form of the flat flexible printed circuit cable is very complicated so as to make it tiresome to construct, assemble and repair.

What is needed is a serial printer which provides for simple assembly and disassembly of the print head from the carriage, simple and positive positioning of the carriage to the driving belt, simple means for adjusting the gap between the head and the platen and a simplified electrical cable connecting the print head to the control system.

SUMMARY OF THE INVENTION

Generally speaking, in accordance with the invention, a serial printer especially suitable for simplified assembly, disassembly and servicing is provided. The print head includes a protruding plug which is seated and locked into a receptacle on a translating carriage. An endless belt has teeth engaged in a correspondingly contoured groove of the carriage for positive connection between the carriage and the belt. The platen is positively and simply held and the gap between the head and platen is readily adjustable by means of an offset mounting shaft. The carriage is mounted to two transverse shafts and continuous lubrication is provided along one shaft. A flexible print cable which uses a small number of parts is provided and difficulties from static electricity are avoided.

Accordingly, it is an object of this invention to provide an improved serial printer wherein the print head is easily mounted on the head carriage and easily removed.

Another object of this invention is to provide an improved serial printer which is low in cost and the print head is readily mounted to the head carriage using only a small number of parts.

A further object of this invention is to provide an improved serial printer wherein the head carriage is simply fixed on an endless belt with teeth for transporting the head carriage, and release of the head carriage from the endless belt is readily accomplished.

Still another object of this invention is to provide an improved serial printer having a mechanism for adjusting the gap between the print head and the platen, said mechanism being comprised of a small number of inexpensive parts.

Yet another object of this invention is to provide an improved serial printer which is inexpensive and which is easily assembled and adjusted.

Another object of this invention is to provide an improved serial printer wherein worn parts are easily replaced.

Yet another object of this invention is to provide an improved serial printer including a flexible print cable for electrically connecting to the wire dot print head, said cable using a small number of parts and being reliable and easily assembled.

Yet another object of this invention is to provide an improved serial printer wherein the problems in printing caused by static electricity are eliminated.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
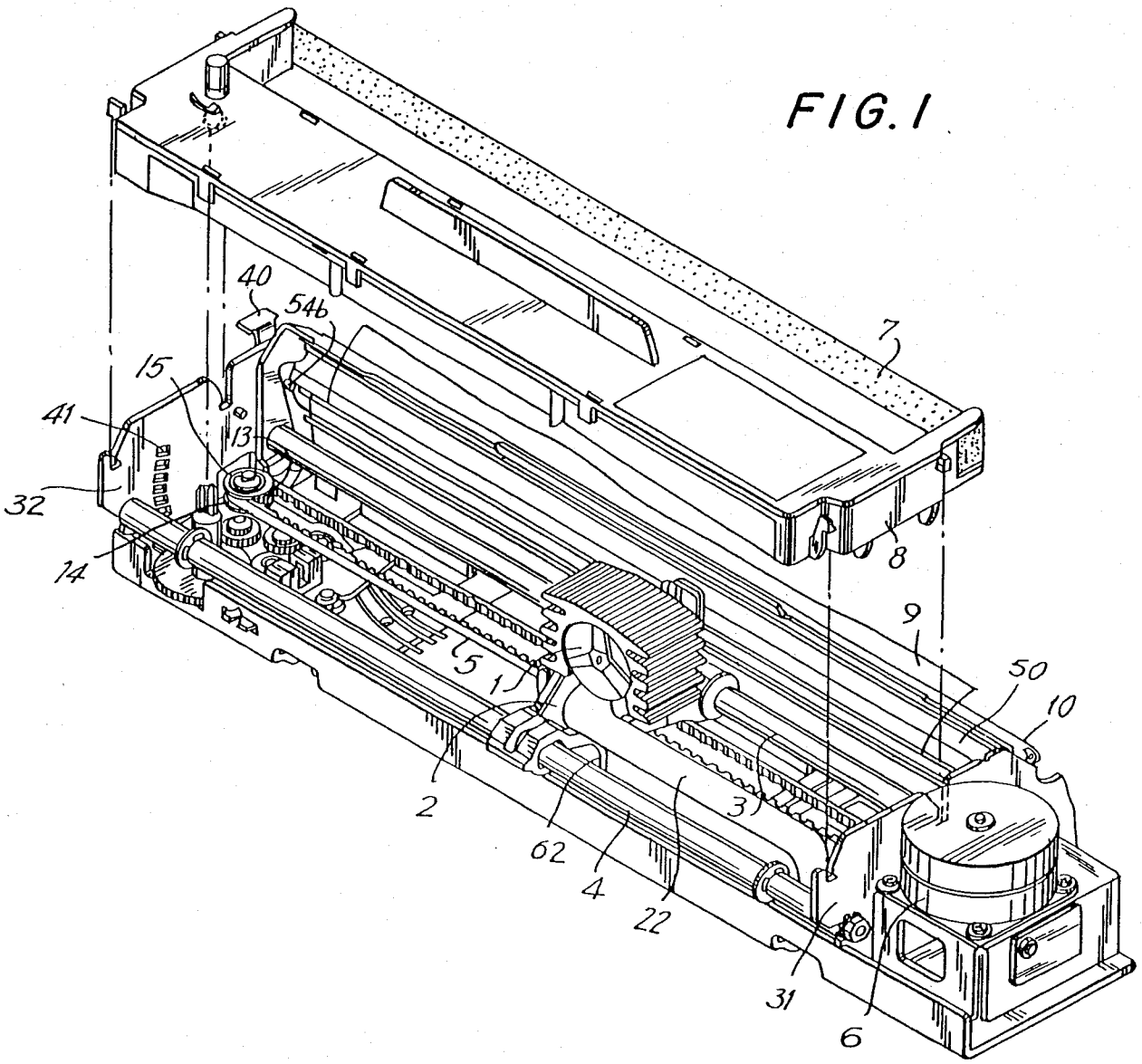
FIG. 1 is a perspective view, partially exploded, showing a serial printer in accordance with the invention.

With reference to the drawings, wherein like reference numerals designate like or corresponding parts throughout the several views, FIG. 1 is a perspective view of a serial printer in accordance with the present invention. The serial printer includes a print head 1, a head carriage 2, a pair of guide shafts 3,4, an endless timing belt 5 having teeth on the inside of its circumference, and a motor 6 driving the timing belt 5. The serial printer also includes an ink ribbon 7, a ribbon cartridge 8 for storing the ink ribbon, a recording sheet 9, a scale 10 for recognition of the positions of printed characters, a flexible print cable 22 for the print head 1, side frames 31,32, an adjusting lever 40 for adjusting the gap between the print head 1 and a platen 50, and a shutter 62 on the carriage 2 for providing home position signals for the printer.

The head carriage 2 with the print head 1 mounted thereon is supported by means of the pair of guide shafts 3,4 in such a manner as to be slidable in the lateral direction, that is, along the length of the shafts 3,4 between the side frames 31,32. As the motor 6 rotates in response to externally applied signals, the head carriage 2 moves both right and left, the print head 1 strikes the recording sheet 9 against the platen 50 through the ribbon 7 in response to printing signals from a print control circuit (not shown) and thus, printing is accomplished.

Figure 2:
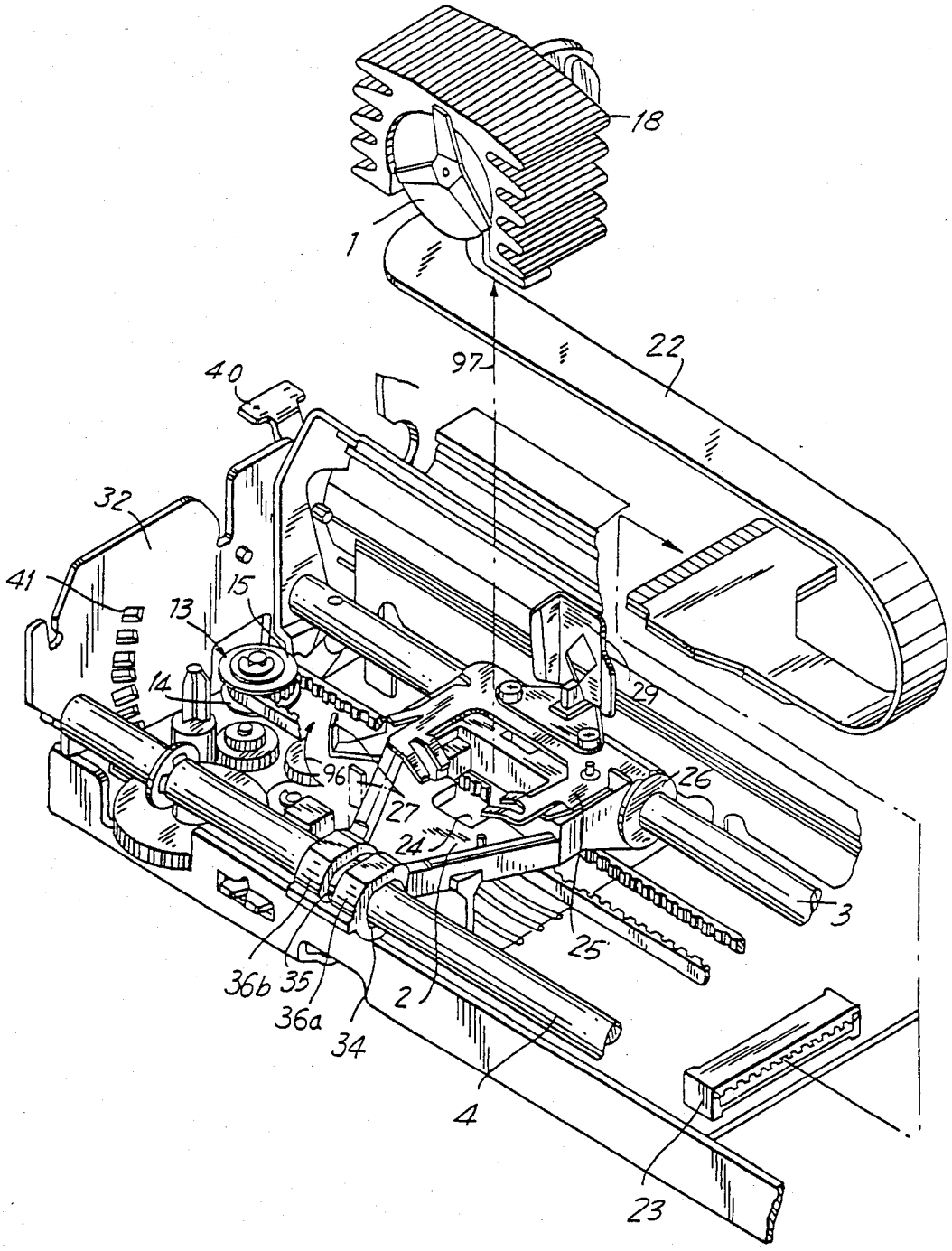
FIG. 2 is a perspective view, partially exploded, showing the mechanism for mounting a print head on a head carriage and for removal therefrom in the serial printer of FIG. 1.
Figure 3:
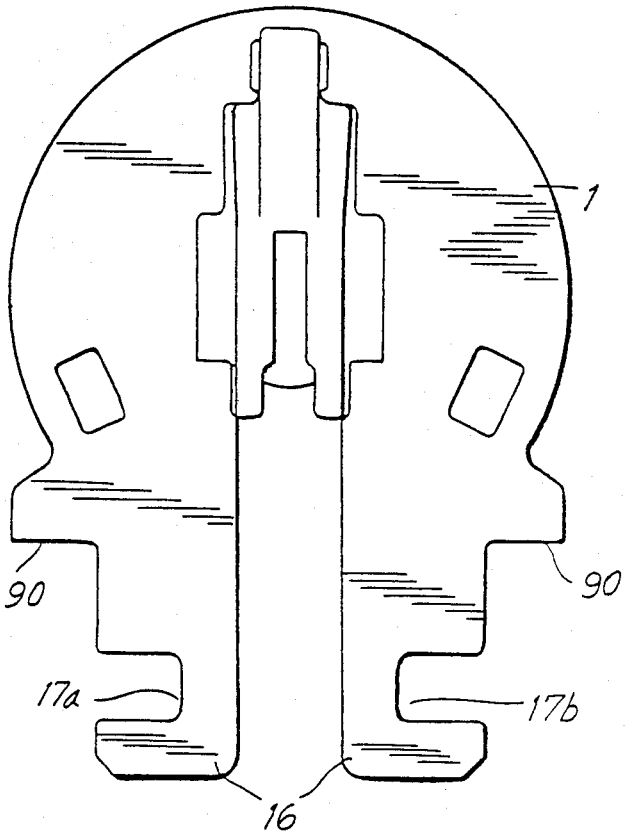
FIG. 3 is a plan view of a portion of the print head carriage of FIG. 1.

As test illustrated in FIG. 2, the head carriage 2 has holes into which bearing members 26 are inserted. The bearing members 26 slide on the first guide shaft 3 and another hole 34 in the head carriage 2 slide on the second shaft 4. The head carriage 2 is formed as one piece by using a plastic material. Further, the head carriage 2 has an opening or receptacle 24 at almost its center. The print head 1 (FIG. 3) includes a protrusion or plug 16 having U-shaped grooves **17*a*,17*b*. The protrusion 16 fits through the opening 24 of the carriage and the shoulders 90 of the plug 16 limit entry of the print head 1 into the opening 24** and provides a positive reference level.

A headlock lever 27 (FIG. 4) comprises locking portions **28*a*,28*b* which are turned in a 180° bend and have resilient properties. The headlock lever 27 is rotatably mounted on the head carriage 2. When mounting the print head 1 on the head carriage 2, the protrusion 16 of the print head 1 is inserted into the opening 24 of the head carriage 2. A spring 39 rotates the head lock lever 27 clockwise. When the print head 1 is not mounted on the head carriage 2, the head lock lever 27 is rotated clockwise, accordingly, the locking portions 28*a* and 28*b* are out of place of the opening 24 of the head carriage 2 and do not obstruct the inserting of the protrusion 16 of the print head into the opening 24. Then, the headlock lever 27 is rotated counterclockwise, that is, in a direction opposite to the arrow 96 shown in FIG. 2 to the position indicated in broken lines in FIG. 2. As the headlock lever 27 is rotated, the locking portions 28*a*,28*b* enter into the grooves 17*a*,17*b* of the print head 1. Due to the resilience of the bent locking portions 28*a*,28*b*, a firm engagement is made between the groove 17*a*,*b* and the locking portion 28*a*,*b* and the print head 1 is securely and positively positioned on the head carriage 2. The protrusion 16 of the print head 1 is inserted in the opening 24 without play, that is, with a tight fit. Therefore, the print head 1** is firmly positioned in place and held there.

When the print head 1 is to be removed from the head carriage 2, the head lock lever 27 is rotated clockwise as indicated by the arrow 96 of FIG. 2, whereby the bent portions **28*a*,*b* are removed from the grooves 17*a*,*b* and the print head 1 is free to be pulled-up as indicated by the vertical arrow 97 of FIG. 2. Thus, the print head 1 is easily mounted and easily removed by simply rotating the head lock lever 27**.

Figure 4:
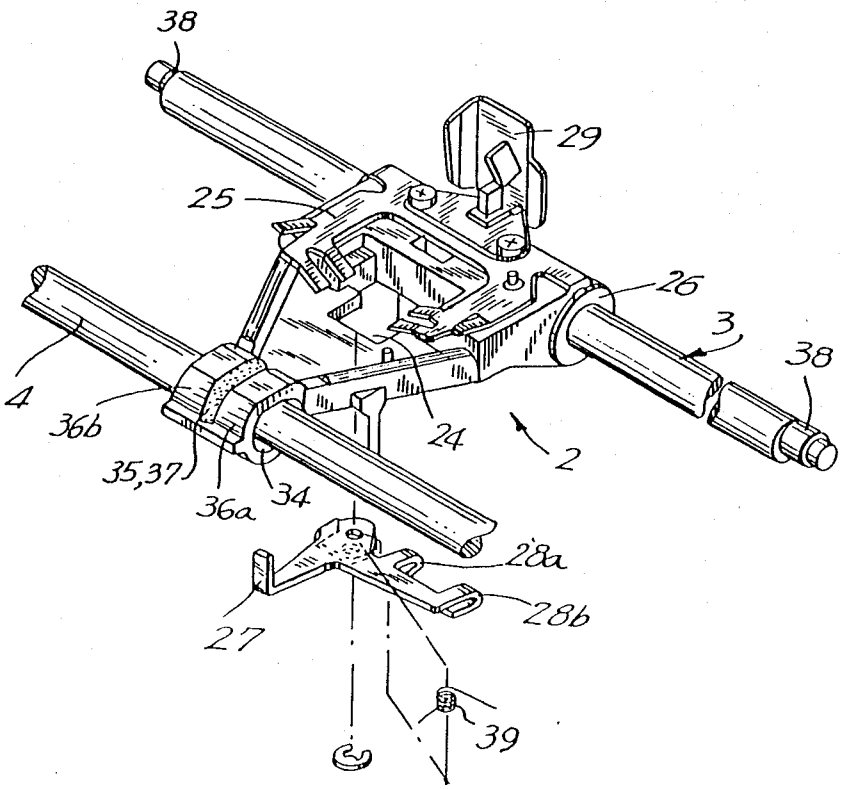
FIG. 4 is a partial perspective view, partially exploded, showing the head carriage and head mounting mechanism in accordance with the serial printer of FIG. 1.

As best seen in FIGS. 2 and 4, a board 25 is positioned on the head carriage 2, the board 25 being made of an electrically conductive material. More specifically, the board 25 is made of resilient metal such as a thin stainless steel sheet, or the like. The board 25 extends to and makes contact with the bearing members 26 of the carriage 2, which as stated above, slide on the first guide shaft which is metal. The bearing members 26 are made of oil-impregnated metal. When the print head 1 is mounted on the head carriage 2 and locked in place by means of the head lock lever 27, the shape of the board 25 is altered in opposition to the inherent resilience of the board 25. For that reason, the print head 1 is grounded to the printer frames 31,32 through the board 25, the bearing members 26 and the first guide shaft 3 which is supported on the side frames. In turn, the printer frame 32 is grounded to the power source (not shown) and the print head never encounters obstacles to printing caused by electro-static noise which might interfere with the control signals. Moreover, due to the resilience of the board 25, the print head 1 is more securely mounted.

The head carriage 2 (FIG. 2) engages the second guide shaft 4 with a bearing portion which encloses the shaft 4. The bearing portion is divided into two parts **36*a*,36*b* which have an open groove 35 centered between them. Thus, the head carriage 2 is long so as to engage both the first guide shaft 3 and the second guide shaft 4. Therefore, the carriage 2 slides in a stable manner laterally along the shafts 3,4 without inclining or twisting. An oil impregnated porous material member 37 is inserted into the opening 35 and the oil impregnated porous material 37 provides lubricating action between the carriage 2 and the shaft 4** whereby the life of the carriage is increased.

A ribbon mask 29, mounted on the carriage 2, prevents the recording sheets (not shown in FIGS. 2,4) from rubbing against the ink ribbon and becoming soiled.

Figure 5:
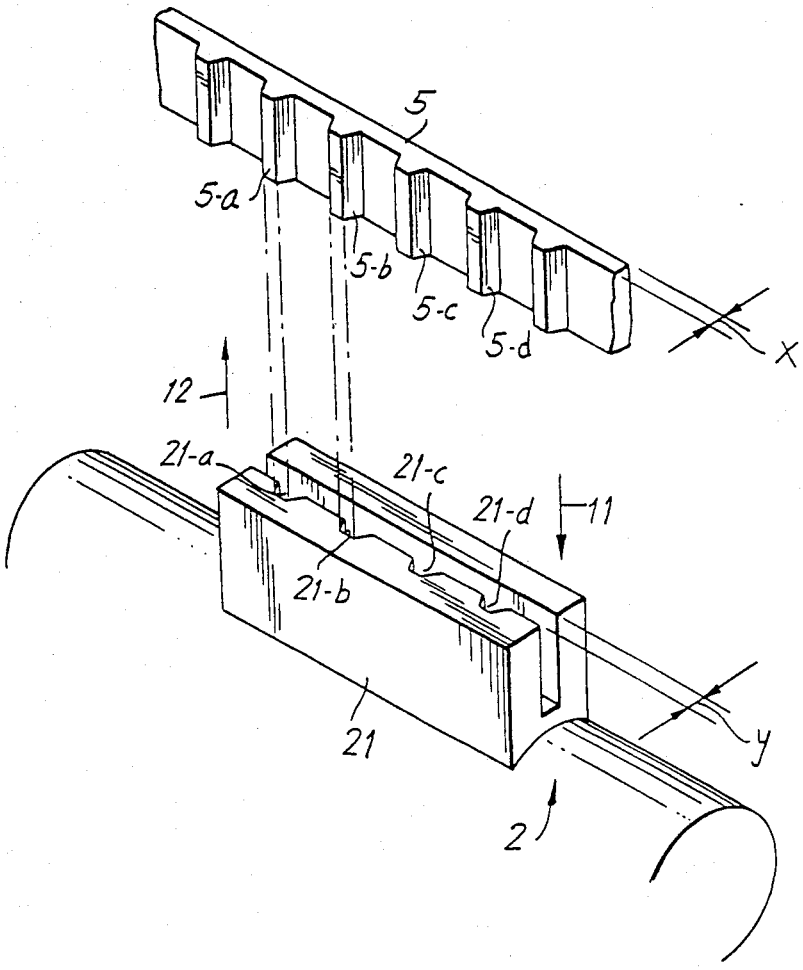
FIG. 5 is a partial perspective view, partially exploded, showing the connection between the head carriage and a timing belt in accordance with this invention.

FIG. 5 shows the connection between the head carriage 2 and the timing belt 5 as would be seen if the printer were turned upside down. The head carriage 2 includes a portion 21 connected to the timing belt 5. On the connecting portion 21, concavities **21*a*–21*d* are formed on an inner side surface of a central groove in the portion 21. The concave teeth 21*a*–21*d* are shaped to correspond with teeth, for example, teeth 5*a*–5*d* of the timing belt 5, which has teeth on only one side. The connecting portion 21 is easily formed as an integral part of the head carriage 2** by means plastic molding, die casting or the like.

The timing belt 5 is inserted into the connecting portion 21 in the direction indicated by the arrow 11 and thereby the head carriage 2 is connected positively to the timing belt 5. With regard to play in the connection between the head carriage 2 and the timing belt 5, the dimension y of the portion 21 is made a little less than the dimension x of the timing belt 5, and the number of teeth of the timing belt 5 which engage with those concave portions of the connecting portion 21 are increased, for example, to four as illustrated. As a result, dimensional errors in both the timing belt 5 and the connecting portion 21 can offset each other and play is absorbed to make a firm connection.

The timing belt 5 engages with a belt driven pulley 13 (FIG. 1) and a belt driving pulley on the opposite side (not shown). The pulley 13 includes flanges 14,15 so that the timing belt 5 is prevented from coming off the pulleys. Simultaneously, the timing belt 5 is prevented from disengaging with the connecting portion 21 (arrow 12, FIG. 5) of the carriage 2 due to the flanges 14 and 15 which constrain the belt 5. Because of the above described construction wherein the head carriage 2 is engaged or disengaged from the timing belt 5 without the use of screws, bolts, or the like, these components can be easily connected or separated.

Figure 6:
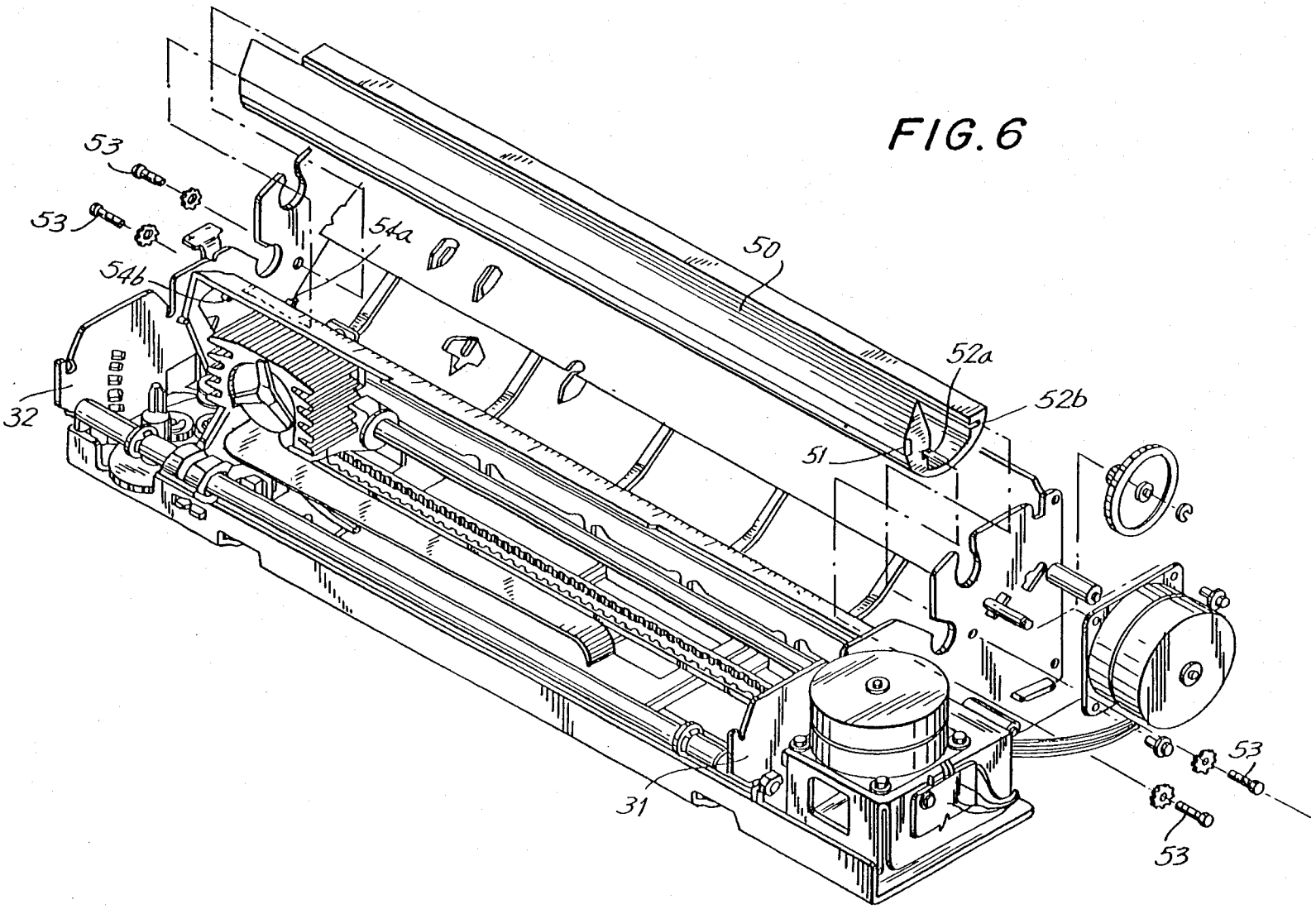
FIG. 6 is a perspective view, partially exploded, with parts removed showing the platen and frame of the serial printer of FIG. 1.

With reference to FIG. 6, a cross-section of the platen 50 comprises a semi-circular periphery having a concave opening on the inside of the circumference. A relatively small concave groove 92 is formed on the outer periphery of the platen 50 and a striking member 51 made of a synthetic resin such as nylon or the like is inserted in the concave groove 92 and held therein by a bonding material, for example, an adhesion tape (not shown) on the striking member 51. The print head 1 strikes against the striking member 51 through a ribbon and recording sheets (not shown). Because the striking member 51 is made of synthetic resins, there are the advantages that the printing impact from the print head is better absorbed and the noise of printing is reduced, especially when compared to a metal platen. Even after the striking member 51 has been worn out because of impacts in printing, the striking member 51 is easily removed and replaced with a new one.

Figure 7:
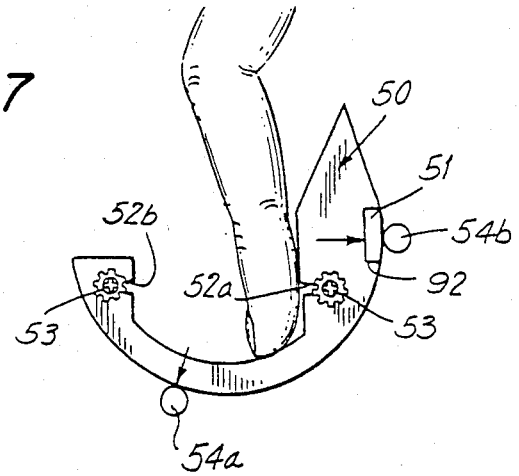
FIG. 7 is a side view of the platen and positioning pins of the serial printer of FIG. 1.

As seen in FIGS. 6 and 7, positioning pins **54*a*,54*b* are provided on the side frames 31,32. When the platen 50 is set on the frames 31,32, the platen 50 is pressed against the positioning pins 54*a*,54*b* and set by means of fastening screws 53. Thus, due to the positioning pin 54*a*,54*b* which are fixed, the gap between the striking member 51 on the platen 59 and the print head 1** can be easily and suitably adjusted.

U-shaped grooves **52*a*,52*b* are formed as part of the inner surface of the concave interior of the platen 50. The platen 50, made of extruded aluminum and including the concave interior, U-shaped grooves 52*a*,52*b* and the concave groove 92 into which the striking member 51 is inserted, is produced as an entirely integral component. In setting the platen 50 on the frames 31,32, tapping screws 53 are fastened into the grooves 52*a*,52*b***. Thus, in the platen in accordance with this invention, it is not necessary to tap threads in a female socket and the cost of the components is reduced.

The first guide shaft 3 is a stepped shaft having portions of two different diameters (FIG. 4). Spindles 38 forming the ends of the first guide shaft are inserted into openings in the frames 31,32 and the spindle portion of the shaft 3 on which the bearing members 26 of the head carriage 2 slide, is offset from the end spindles 38, that is, the spindles 38 are not concentric with the portion where the bearing members 26 are slidably mounted. The spindles 38 are rotatably engaged with the frames 31,32.

Figure 8:
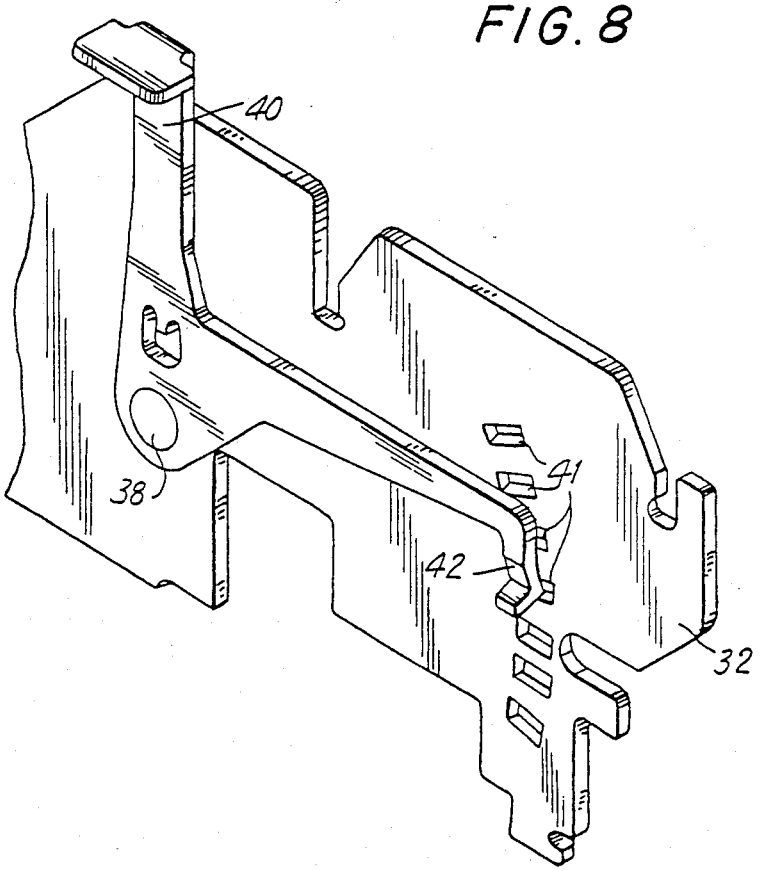
FIG. 8 is a partial perspective view to an enlarged scale of the platen adjusting lever of the serial printer of FIG. 1.

The hole 34 of the head carriage portion **36*a*,36*b* through which the second guide shaft 4 passes, is oval. An almost L-shaped adjustment lever 40 (FIG. 8) is fixedly attached on a spindle 38. One end portion 42 of the L-shaped adjustment lever 40 is bent into a V which has resilience. Additionally, the V-shaped portion 42 of the lever 40 engages with a positioning hole 41 in the frame 32. On rotating the adjustment lever 40 about the spindle 38, the guide shaft portion to which the carriage 2 is mounted by bearing members 26 rotates. Accordingly, the head carriage moves back and forth, away from and toward the platen as desired, so that the gap between the print head 1 and the platen 50 is adjusted. The adjustment lever 40 itself has such resilience that it engages with a positioning hole 41 of the frame 32** and the platen position is maintained secure. The gap adjusting mechanism is constructed of a small number of parts and is provided at low cost.

Figure 9:
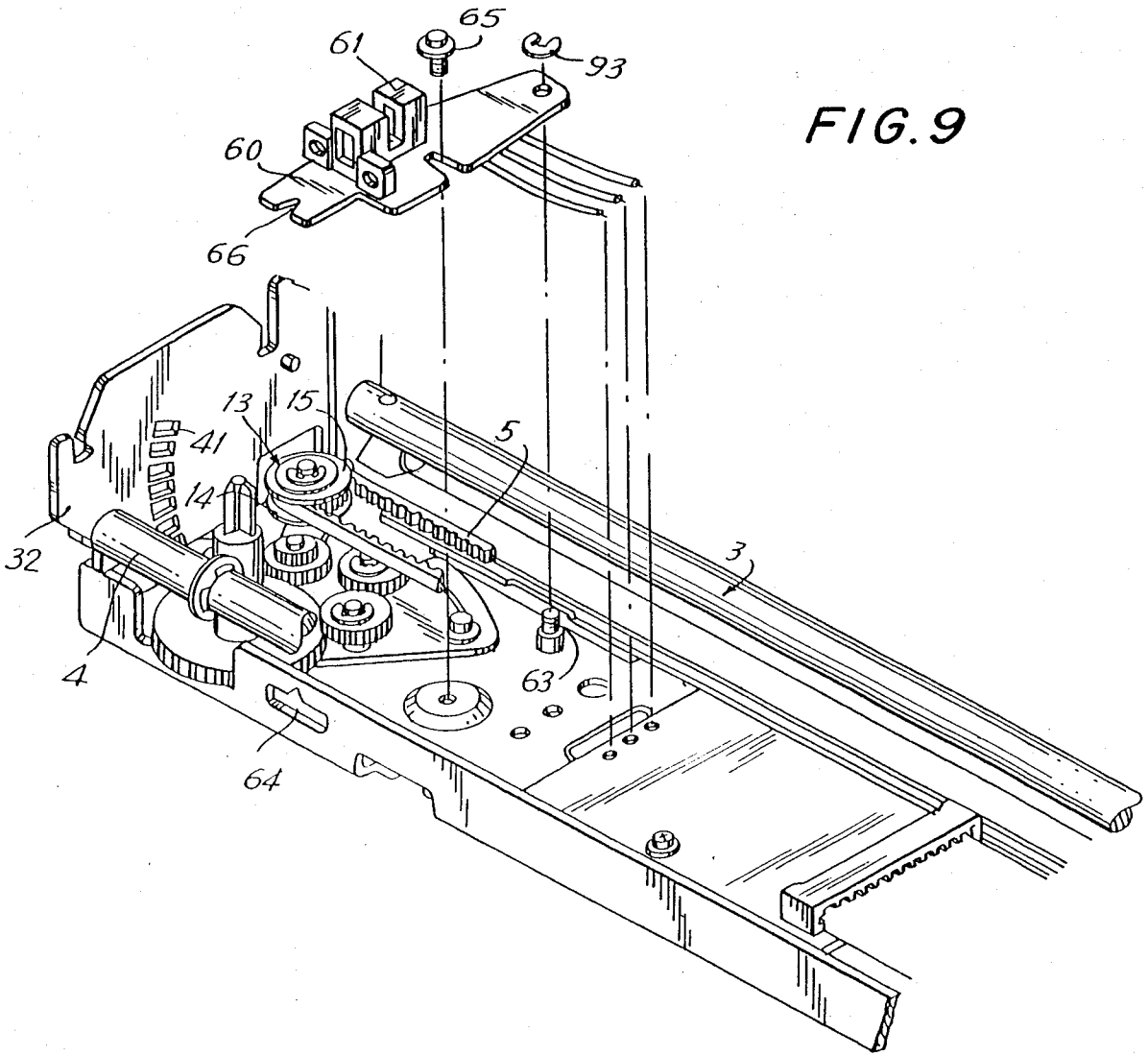
FIG. 9 is a perspective view, partially exploded, showing the mounting of a home position detector on the serial printer of FIG. 1.
Figure 10:
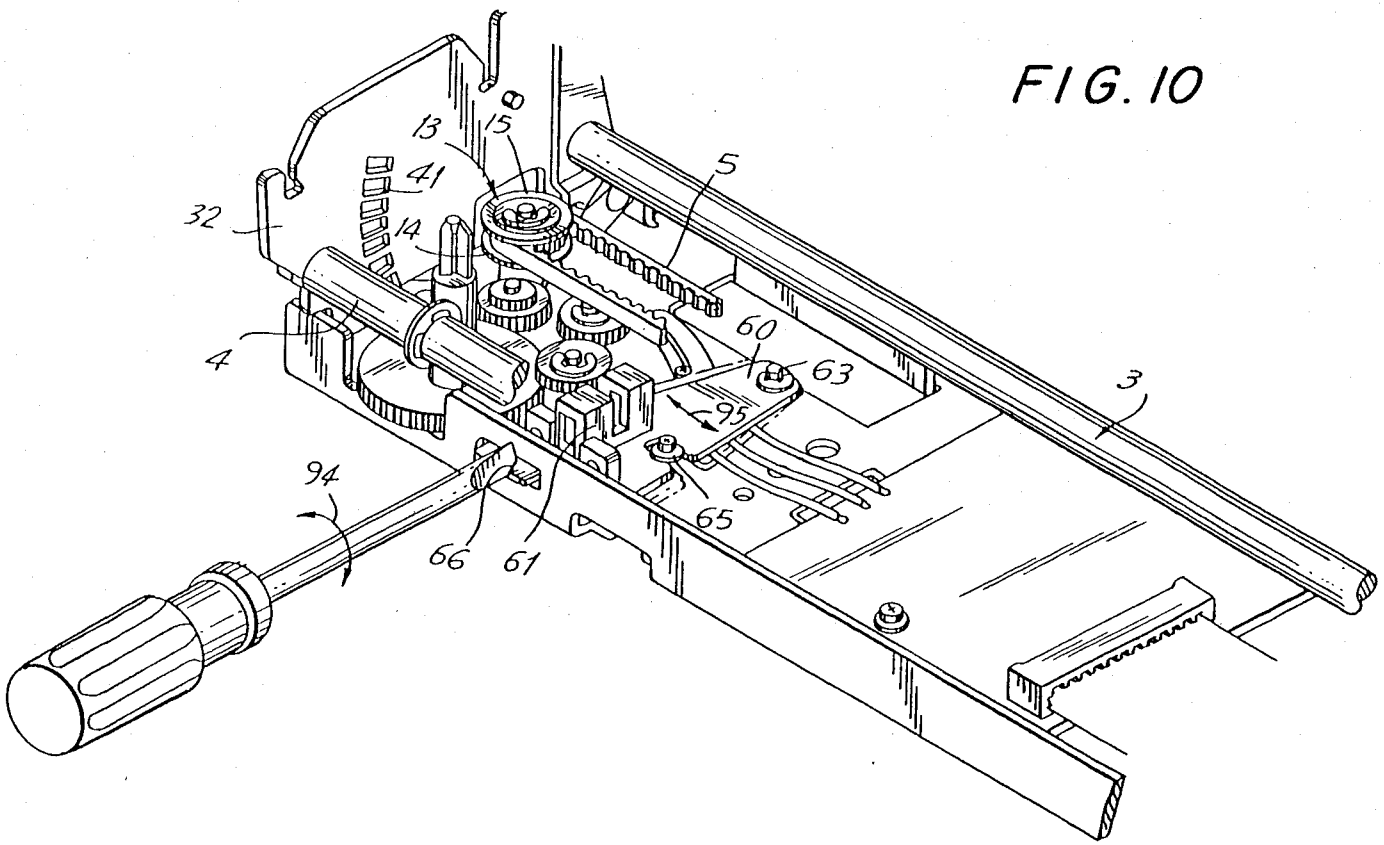
FIG. 10 is a perspective view showing the adjustment technique or the home position detector of FIG. 9.

With reference to FIGS. 9 and 10, the construction and method of setting the home position sensor of the serial printer in accordance with the invention, are illustrated. A home position sensor 61 is formed of elements such as a photo-transistor and light emitting diode, for example, which are fixed on a sensor board 60. The sensor board 60, includes a notch 66 in a portion and is rotatably mounted on an axis 63 and retained there by a retaining ring 93 so that it is pivotably held. The board 60 is fixed in position by means of a screw 65 which seats in the under frame of the printer. A shutter 62 (FIG. 1) for the home position sensor 61 is formed integrally on the head carriage 2. As the head carriage 2 shifts to the right and left and the shutter 62 crosses a slot in the home position sensor 61, a home position signal is produced in the known manner and is transmitted to a control circuit (not shown).

On the printer frame, an elongated opening 64 is formed having an upward notch along the upper edge. To adjust the position of the home position sensor 61, the screw 65 is loosened slightly. A screw driver is inserted through the opening 64 aligned by the notch in the upper edge and inserted into the notch 66 in the leading edge of the sensor board 60. Turning the screwdriver as indicated by the arrow 94 (FIG. 10) causes the sensor board 60 to pivot about the axis 63 in the direction indicated by the arrow 95. By this method, a slight adjustment is readily accomplished.

The electrical connection of the print head of the serial printer in accordance with the invention to a flexible print cable is now described. Coil cores 72 project from a frame 71 (FIGS. 11,12) being individually located in equi-spaced positions on a circle. An individual operating lever 74, connected to a plunger 73, is positioned so as to face each coil core 72. One end portion of each operating lever 74 is engaged with a yoke board 76 and held in position by a holding member 75. This contact is a fulcrum 74*a* for pivoting of the operating lever 74. The other end of each operating lever is in contact with a backstop 78 as a result of the force of a wire return spring 77 acting on the end of a wire 79 which in turn is in contact with the end of the lever 74. This is a standby position. Each wire 79 is so guided as to be independently slidable longitudinally and is held in engagement with the operating lever 74 by the return spring 77 in the standby condition.

A coil 81 is inserted around the coil core 72. Into one part 82 of a coil bobbin for the coil 81, a pin 83 is inserted, and the electrical terminal of the coil winding is wound around the pin 83. The pin 83 penetrates through the hole 71*a* formed into the frame 71 and then is soldered to a flexible print cable 22.

Figure 11:
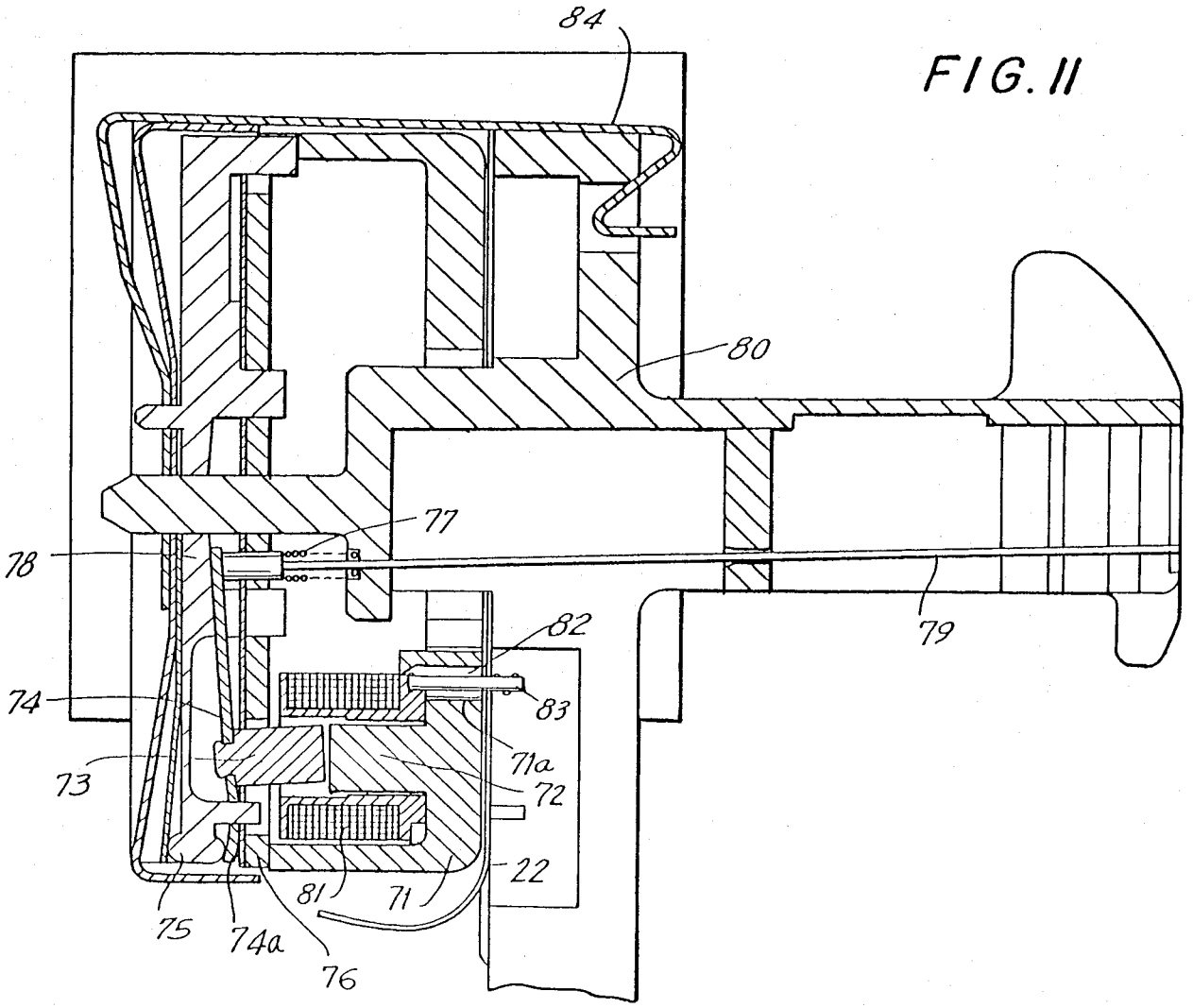
FIG. 11 is a sectional view of a wire dot print head of the serial printer of FIG. 1.

For the purpose of simplifying the drawing of FIG. 11, only one pair, that is, a pin and a terminal of the coil winding is shown in FIG. 11. However, each coil is provided with two pins and terminals corresponding to the beginning and end of the coil winding.

Figure 12:
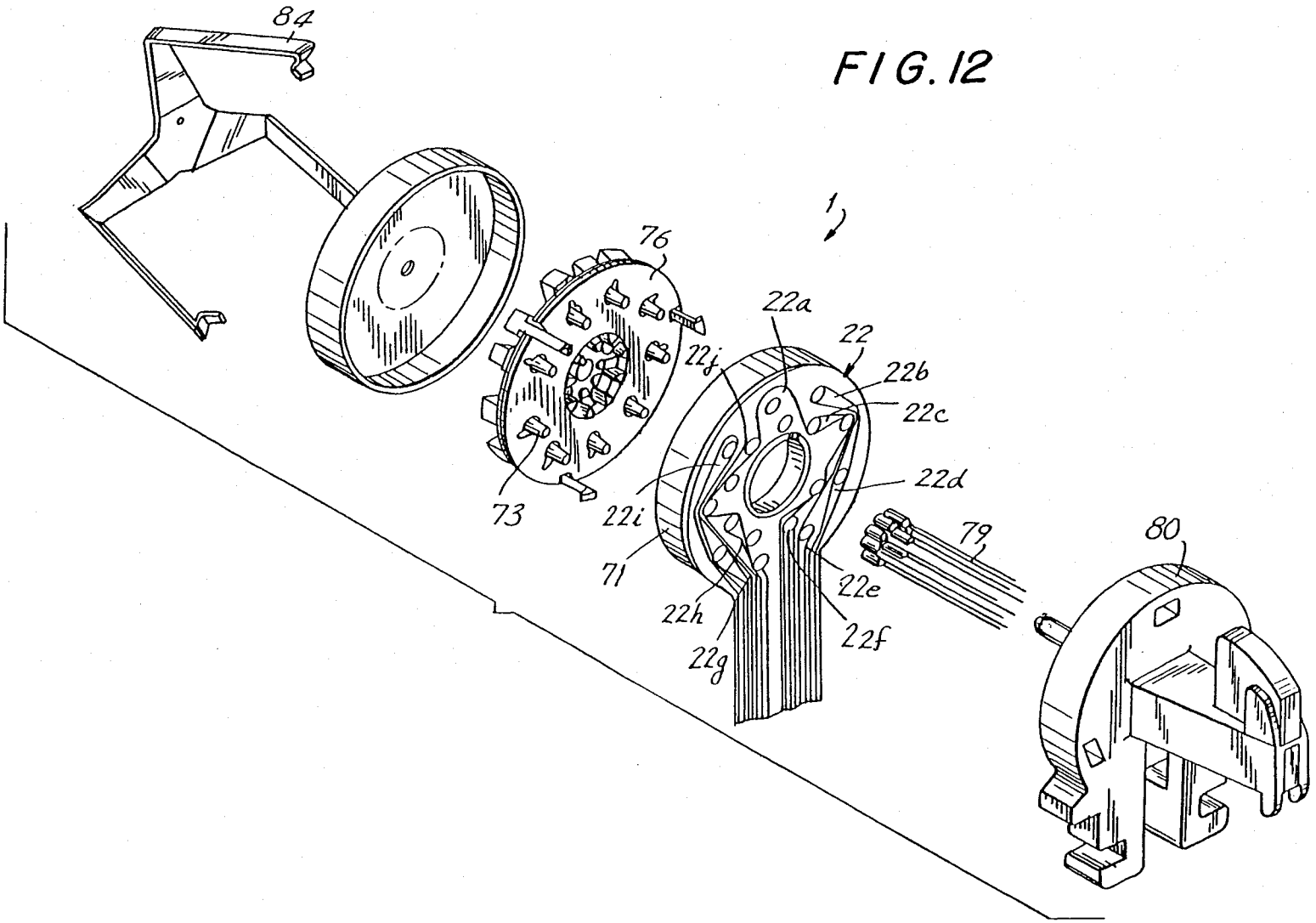
FIG. 12 is a perspective exploded view of the print head of FIG. 11 and a combination of the driving coils with a flexible print cable.

As best seen in FIG. 12, the flexible print cable 22 includes a common conductor portion 22*a*, conductor portions 22*b*,22*c*, . . . 22*j* corresponding to each coil. Each coil winding has one pin around which a terminal of the coil is wound, soldered to the common conductor portion 22*a* and the other pin and terminal connected to one of the conductor portions 22*b* . . . 22*j*.

When the components (FIG. 12) of the print head 1 are compressed together for use, the print cable 22 is held in place by a pressure contact with the nose piece 80. Therefore, the print head 1 and the flexible print cable 22 are properly connected and even when the print head moves at high speed in printing, breaking of wires or faulty contact never occurs. As seen in FIG. 2, the other end of the flexible print cable 22 is inserted into a connector 23 so that signals for printing are transmitted from a control circuit (not shown) to the coils 81 by way of the flexible print cable 22. A lockspring 84 holds the printer head 1 together by engagement with the nosepiece 80 with all other components sandwiched between.

A printing operation is now described in detail. When a signal for printing is transmitted through the flexible print cable 22 to a coil 81, the associated operating lever 74 is attracted toward the coil 81. Thereby, a wire 79 associated with that selected lever is released and extends from the front of the nosepiece 80 and strikes a recording sheet or sheets (not shown) through an ink ribbon (not shown). Thus, printing is accomplished. After printing, the operating lever 74 and wire 79 are returned to the standby position by the wire return spring 77 which was compressed when the coil was actuated for printing. The lever 74 and print wire 79 are held in the standby position until the next actuating signal is transmitted to the associated coil.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A serial printer comprising:

a print head for printing characters on recording sheet;

a pair of side frames, said side frames being spaced apart;

first and second guide shafts provided between said side frames of said printer;

a platen facing said print head, said platen being in a fixed position relative to said side frames, said print head striking on said platen with said recording sheet therebetween to accomplish said printing of characters;

a head carriage supporting said print head and adapted to move across said sheet, said head carriage being guided by said first and second guide shafts, said head carriage having at least one first hole, said first guide shaft passing through as said at least one first hole and sliding thereon said head carriage further including a second hole, said second hole being oval in shape and sliding on said second guide shaft, said first guide shaft being offset, having non-concentric portions of first and second diameters, the end portions of said first guide shaft of said first diameter being rotatably engaged with said side frames, a central portion of said first guide shaft of said second diameter riding in said at least one first hole, and an adjustment lever for varying the distance between the print head and the platen fixed to an end portion of said first guide shaft for rotation therewith, and adapted to releasably engage one said side frame adjacent to said adjustment lever, rotation of said adjustment lever and said connected end portion causing movement of said offset central portion causing said print head to move on said carriage relative to said platen, the adjustment lever having a first end and a second end, said second end being resilient and formed with a portion projecting and biased toward said adjacent side frame, said side frame adjacent to said adjustment lever being formed with a plurality of positioning holes, said projecting portion engaging and biased into one of said positioning holes, said projecting portion being releasable from said selected positioning hole by applying a force to the first end of said lever overcoming said bias and the resilience in said second end absorbing any backlash transmitted by the guide shaft.

2. A serial printer as claimed in claim 1, wherein said adjustment lever is substantially L-shaped.

3. A serial printer as claimed in claim 1, and further comprising bearing members lining said at least one first hole, said first guide shaft sliding on said bearing members.

4. The serial printer of claim 1, wherein said projecting portion is V-shaped.

* * * * *